US007959469B2

(12) United States Patent
Kawamura et al.

(10) Patent No.: US 7,959,469 B2
(45) Date of Patent: Jun. 14, 2011

(54) CONNECTOR DEVICE AND CONNECTOR ASSEMBLY

(75) Inventors: Masayuki Kawamura, Yokkaichi (JP); Hiroyuki Matsuoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/700,305

(22) Filed: Feb. 4, 2010

(65) Prior Publication Data

US 2010/0216323 A1 Aug. 26, 2010

(30) Foreign Application Priority Data

Feb. 23, 2009 (JP) ..... 2009-039599

(51) Int. Cl.
*H01R 13/648* (2006.01)

(52) U.S. Cl. ..... 439/607.55; 439/607.01; 439/573

(58) Field of Classification Search ..... 439/607.55, 439/607.01, 362, 573, 564
See application file for complete search history.

(56) References Cited

U.S. PATENT DOCUMENTS

| | | | | |
|---|---|---|---|---|
| 6,786,770 | B1 * | 9/2004 | Huang | 439/607.55 |
| 7,018,237 | B2 * | 3/2006 | Zhan et al. | 439/607.55 |
| 2007/0202733 | A1 * | 8/2007 | Rose et al. | 439/362 |

FOREIGN PATENT DOCUMENTS

JP 2006-196198 7/2006

* cited by examiner

*Primary Examiner* — Gary F. Paumen
(74) *Attorney, Agent, or Firm* — Gerald E. Hespos; Michael J. Porco

(57) ABSTRACT

A connector device (10) has a connector (20) to be mounted on a metal case (11) that accommodates a device therein and is covered by a first shield shell (50) and a second shield shell (60). Connecting portions for connecting the first and second shield shells (50, 60) are provided at least at three positions and these connecting portions are arranged at positions displaced in a connecting direction of the connector (20) and a mating connector (40) and a direction orthogonal to the connecting direction. The connecting positions of the first and second shield shells (50, 60) are well-balanced to provide a good a shielding performance.

17 Claims, 9 Drawing Sheets

CONNECTOR DEVICE AND CONNECTOR ASSEMBLY

BACKGROUND OF THE INVENTION

1. Field of the Invention

The invention relates to a connector device including a shield structure and to a connector assembly.

2. Description of the Related Art

Japanese Unexamined Patent Publication No. 2006-196198 discloses a connector device with a shield structure for shielding high-frequency noise. The connector device has a connector that is mounted on a case that contains a motor. A first shield shell is fixed to the case and covers a rear part of the connector. A second shield shell is connected to the first shield shell and covers a front part of a connector. Two contact pieces in the form of leaf springs are provided at the rear of the second shield shell and contact the first shield shell to connect the first and second shield shells electrically. The first and second shield shells are in contact at only two points and hence shielding performance for noise removal is insufficient in some cases.

The invention was developed in view of the above situation and an object thereof is to improve a shielding performance.

SUMMARY OF THE INVENTION

The invention relates to a connector device with a connector to be mounted on a conductive case that has a device therein. The connector is covered substantially by at least first and second shield shells and a second shield shell. Connecting portions connect the first and second shield shells at three or more positions. The connecting portions are arranged at positions displaced in a connecting direction of the connector and a mating connector and a direction orthogonal to the connecting direction. The three or more connecting portions exceed the number of connecting portions that exist in the prior art. Further, the connecting portions are arranged in a well-balanced manner that improves a shielding performance.

The connecting portions may include at least one low connecting portion near the outer surface of the case and at least one high connecting portion more distant from the outer surface of the case than the low connecting portion.

A connecting portion may project out from the case and may be configured for connection with the mating connector.

The first shield shell may include at least one case fixing portion and at least one wall that projects from the case fixing portion. The case fixing portion is to be fixed substantially along the outer surface of the case. The wall preferably extends substantially in a projecting direction of the connecting portion.

The second shield shell may include at least one leg to be substantially on the case fixing portion and at least one main body to be placed substantially on the connecting portion from a side substantially opposite to the case.

The connecting portions of the first shield shell may include at least one first low connecting portion on the case fixing portion and at least one first high connecting portion at the upper end of the wall.

The connecting portions of the second shield shell may include at least one second low connecting portion arranged on the leg to overlap the first low connecting portion and at least one second high connecting portion projecting sideways from the main body and to overlap the first high connecting portion.

The connecting portions of the first and second shield shells may have bolt holes to enable bolt tightening. The bolt tightening enables a contact state of the first and second shield shells to be held reliably held.

The invention also relates to a connector assembly comprising the above described connector device and a mating connector that is connectable with a connector of the connector device.

The mating connector may be connected with the connector along the connecting direction by at least one bolt while the second shield shell is displaced.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
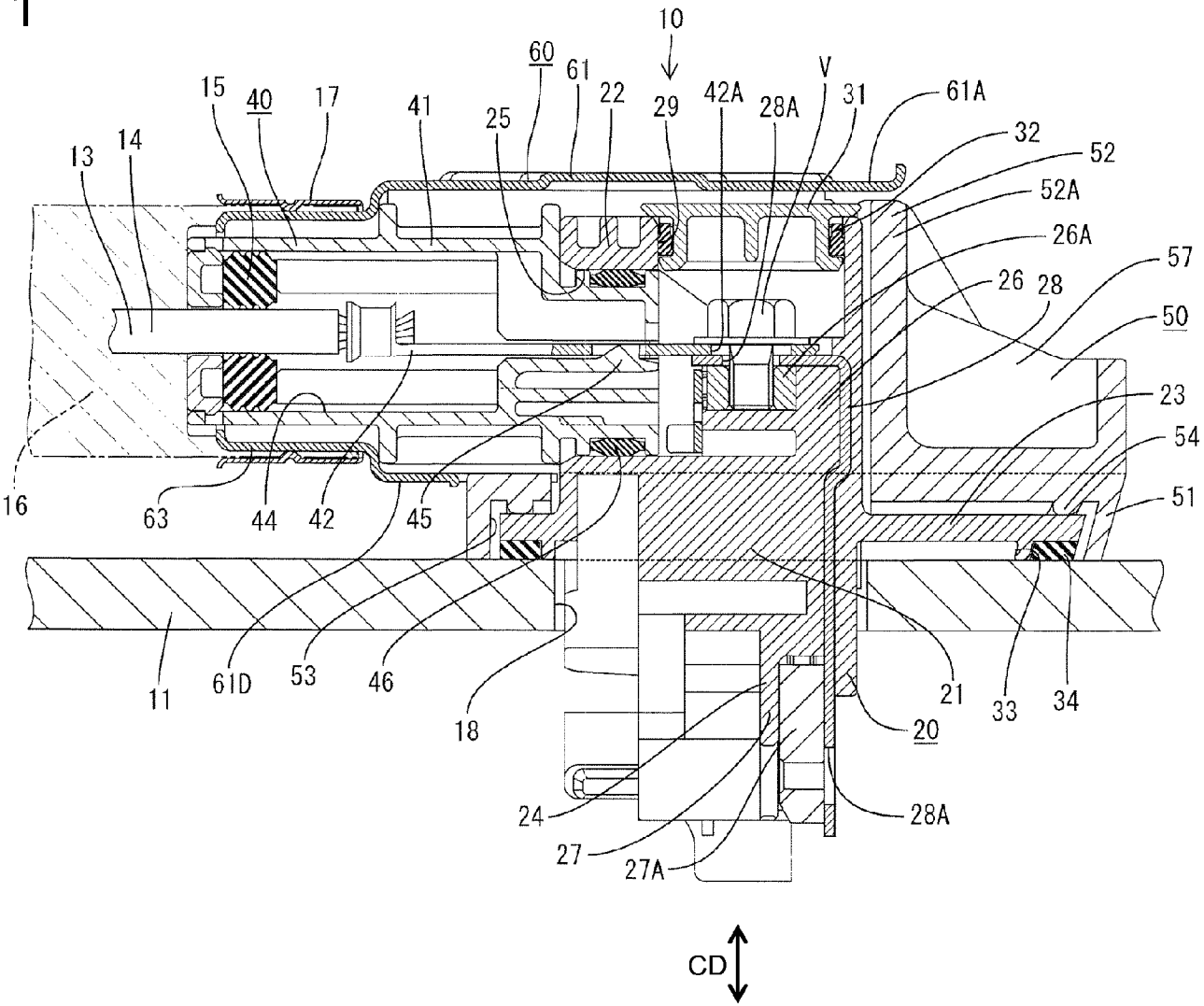
FIG. 1 is a section showing an assembled state of a connector device according to one embodiment.
Figure 2:
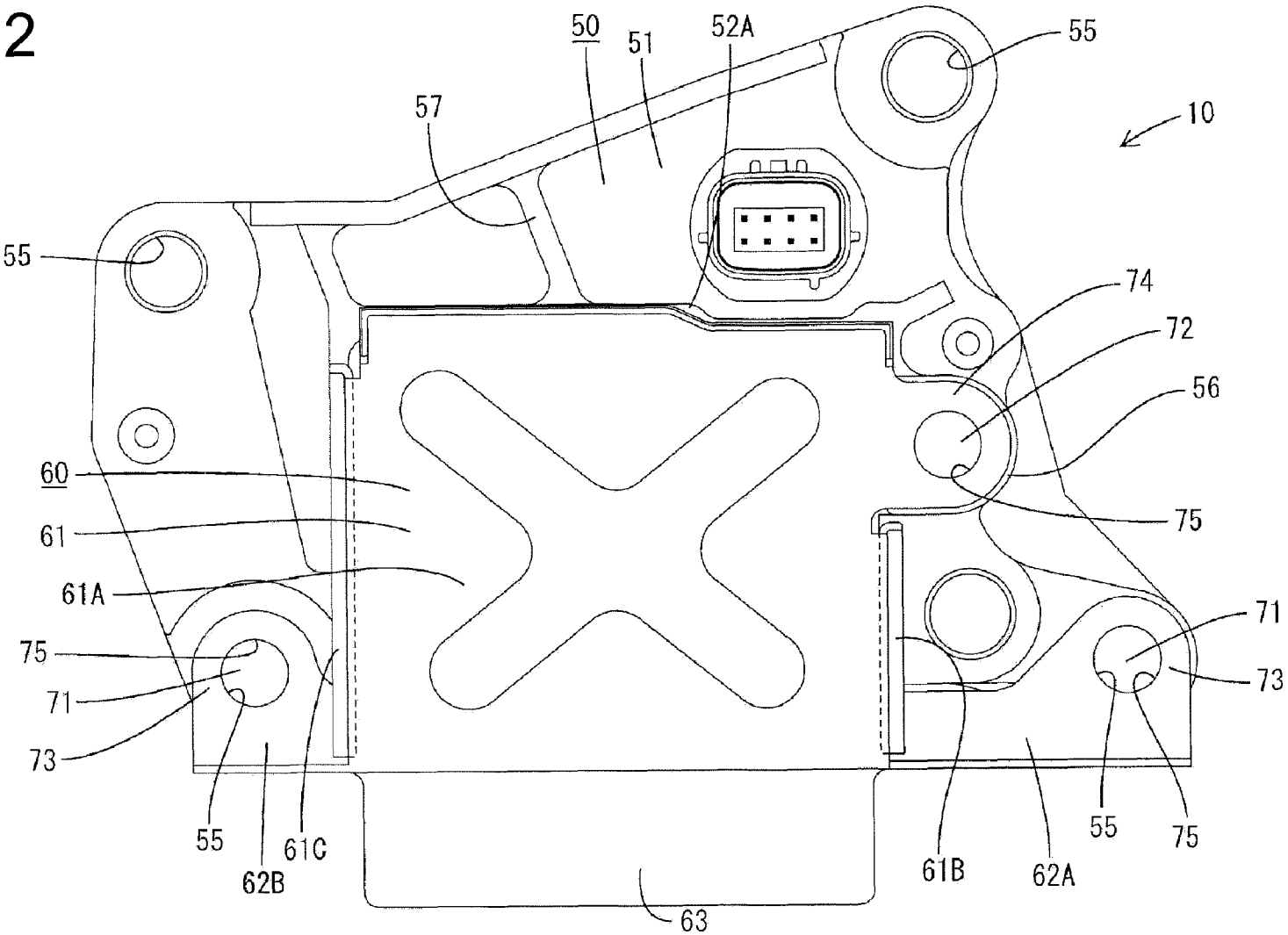
FIG. 2 is a top view of the connector device.
Figure 3:
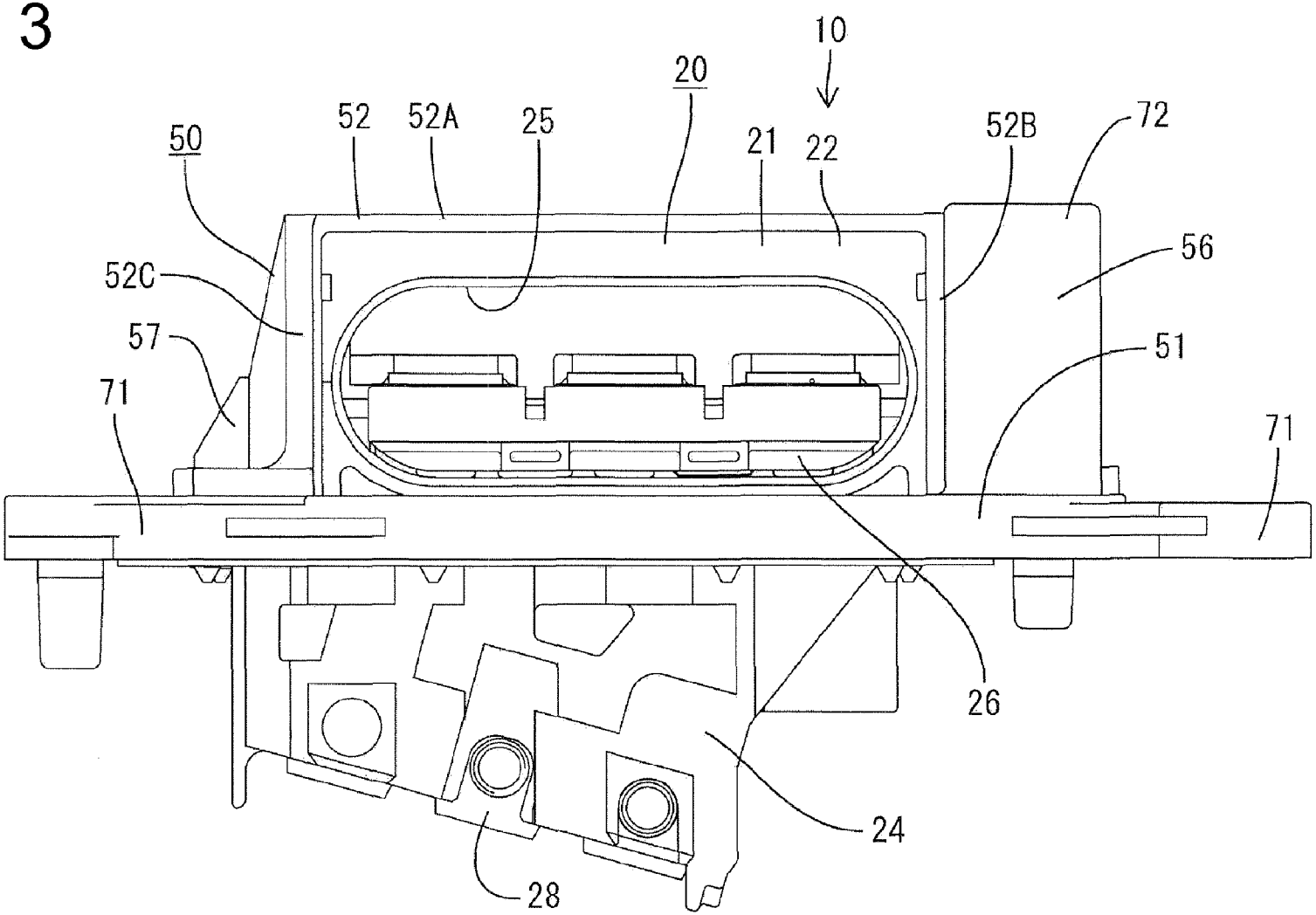
FIG. 3 is a front view of a device side connector having a first shield shell mounted thereon.

A connector device according to the invention is identified by the numeral 10 in FIGS. 1 to 3. The connector device 10 is to be mounted on a conductive metal case 11 that accommodates an unillustrated motor and is connected electrically with the motor and/or with an unillustrated electric or electronic control unit (ECU) for controlling the motor, such as for supplying driving power to the motor. In the following description, upper and lower sides of FIG. 1 are referred to as upper and lower sides.

The connector device 10 has a device side connector 20 to be mounted on the case 11. The device side connector 20 is covered by first and second shield shells 50 and 60. A power supply side connector 40 is external and separate from the connector device 10, but is connected to the device side connector 20.

The device side connector 20 has a device side housing 21 made e.g. of synthetic resin. The device side housing 21 includes a connecting portion 22 substantially in the form of a wide rectangular parallelepiped. A substantially plate-like flange 23 is formed at the bottom end of the connecting portion 22 and extends substantially toward the opposite lateral sides and the rear end. A device side projection 24 projects down from the lower surface of the flange 23.

The device side connector housing 21 is to be mounted in a mount hole 18 of the case 11 so that the connecting portion 22 projects out from the case 11 and the device side projection 24 projects inside the case 11. At this time, the flange 23 is arranged along the outer surface of the case 11.

The connecting portion 22 is substantially in the form of a box with a hollow interior and a wide elliptical connection opening 25 is formed in the front wall of the connecting portion 22. The power supply side connector 40 is connected with an end of a wiring harness 14 of the ECU and can be fit into the connection opening 25 from the front.

Three power supply side mounts 26 are formed substantially side by side in the connecting portion 22, and power supply side nuts 26A are accommodated in the respective power supply side mounts 26. The power supply side nuts 26A are arranged so that their longitudinal axes extend in a vertical direction.

Figure 4:
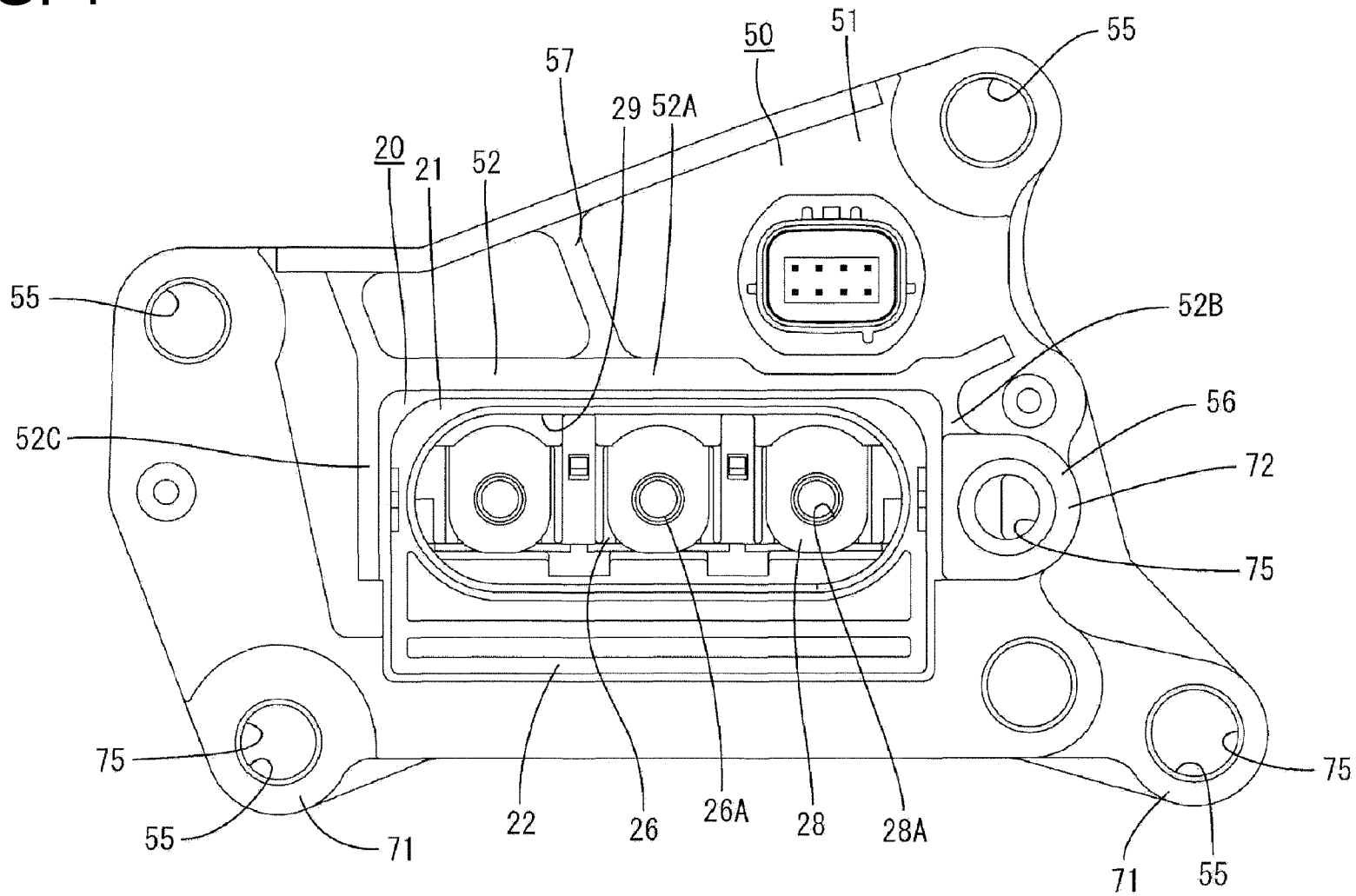
FIG. 4 is a top view of the device side connector having the first shield shell mounted thereon.

An operation hole 29 extends substantially vertically into a part of the upper wall of the connecting portion 22 right above the power supply side mounts 26. As shown in FIG. 4, the operation hole 29 has a wide elliptical shape and the three power supply side mounts 26 are exposed via the operation hole 29. A cap 31 is to be mounted in the operation hole 29 and a seal ring 32 mounted on the cap 31 is held closely in contact with the operation hole 29.

Figure 5:
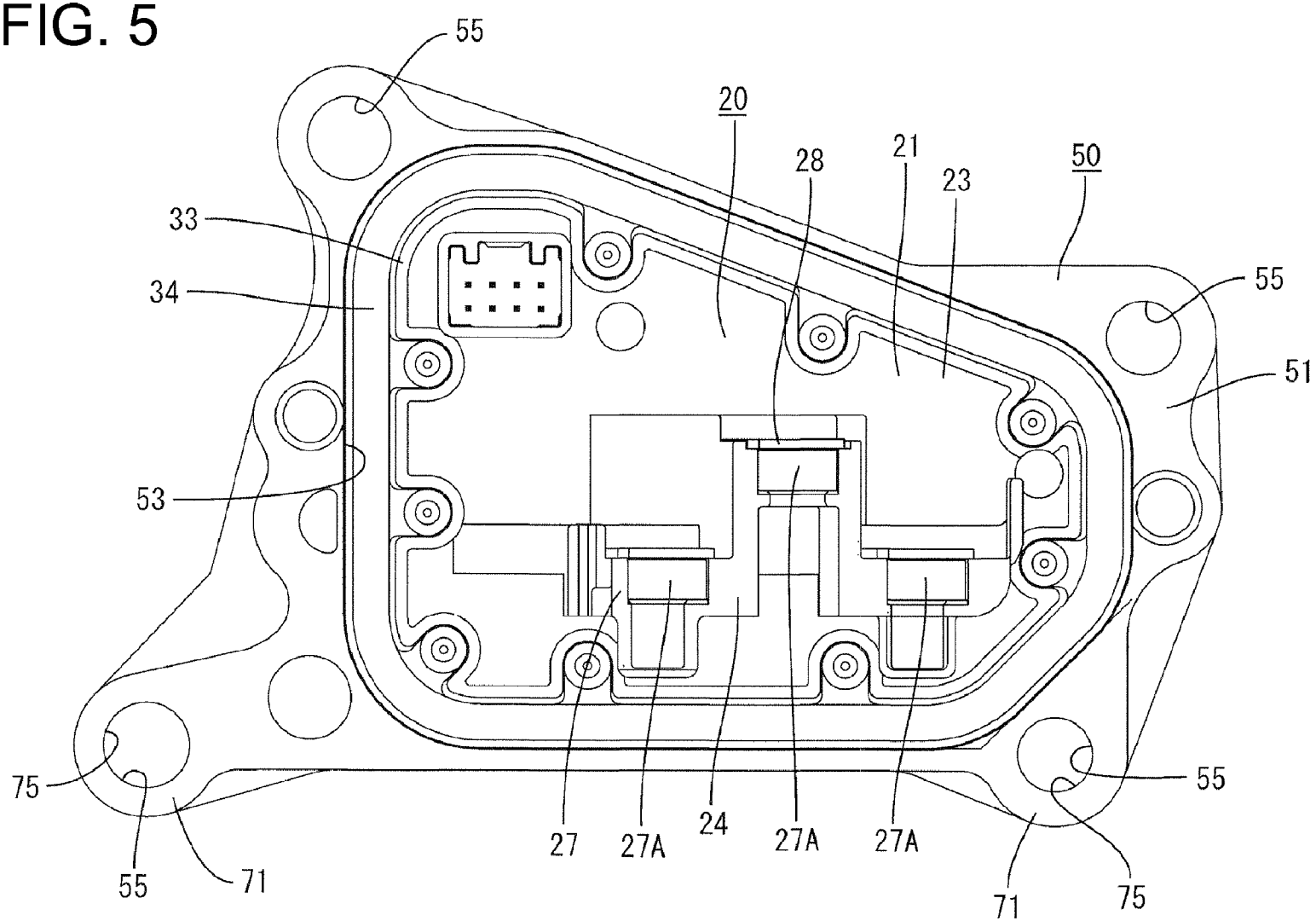
FIG. 5 is a bottom view of the device side connector having the first shield shell mounted thereon
Figure 6:
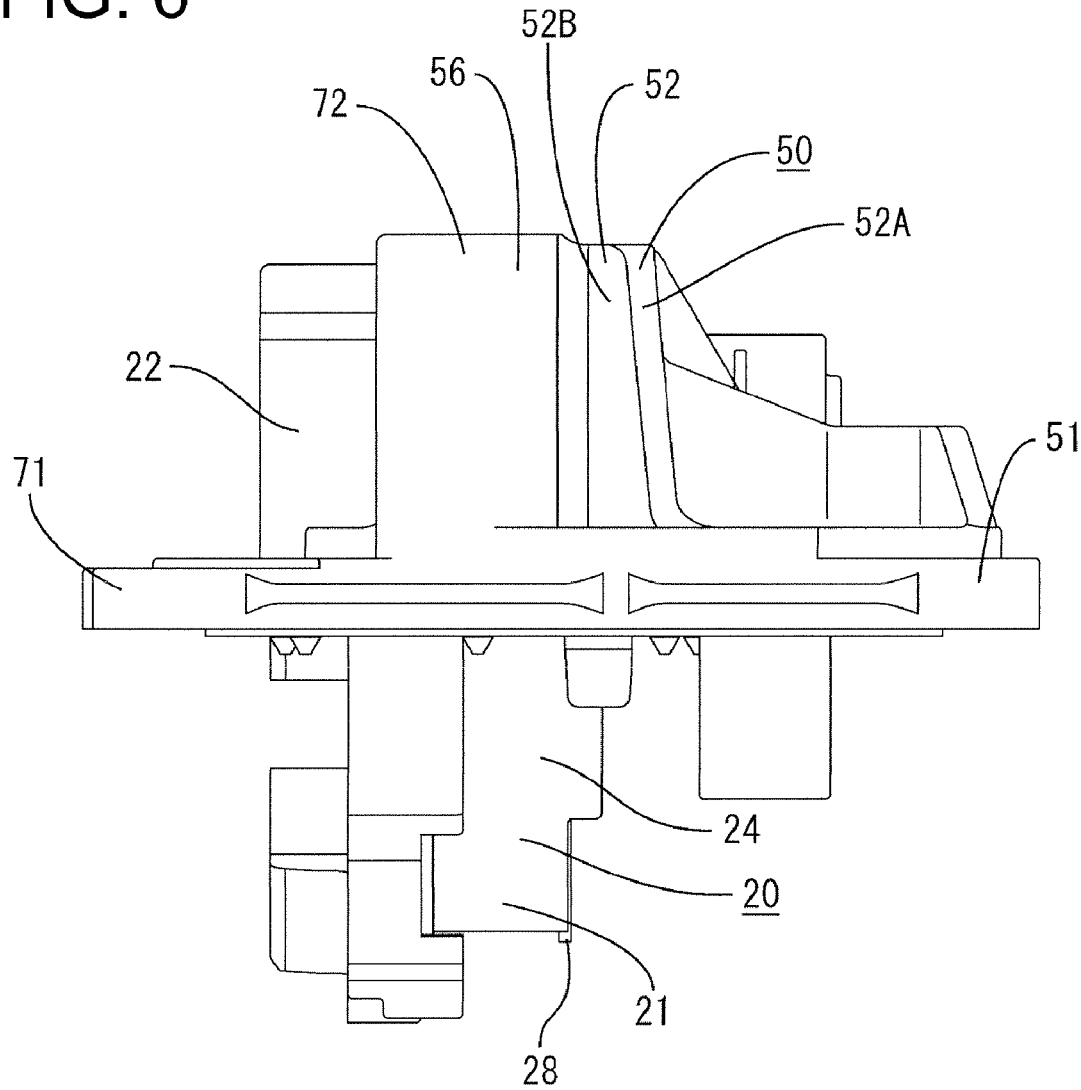
FIG. 6 is a side view of the device side connector having the first shield shell mounted thereon.

A mounting wall 33 extends around the entire periphery of the lower surface of the flange 23, as shown in FIG. 5, and faces the outer surface of the case 11, as shown in FIG. 1. Thus, the mounting wall 33 surrounds the device side projection 24.

A seal 34 is to be mounted on the lower surface of the flange 23 along the outer periphery of the mounting wall 33 and hence surrounds the mount hole 18. The seal 34 is made of a resilient material, such as rubber, and has a substantially constant thickness over the entire periphery.

Three device side mounts 27 are arranged substantially side by side on the device side projection 24. As shown in FIG. 3, the device side mounts 27 are arranged to be more distant from the flange 23 from one end toward the other. Device side nuts 27A are accommodated in the respective device side mounts 27 with their longitudinal axes extending in forward and backward directions.

Three device side terminals 28 are held in the device side connector housing 21. The device side terminals 28 are bent to reach the corresponding device side mounts 27 from the respective power supply side mounts 26 and are united with the device side connector housing 21 preferably by insert molding. One end of each device side terminal 28 is arranged substantially along the upper surface of the power supply side mount 26 and the other end is arranged along the rear surface of the device side mount 27. Bolt insertion holes 28A are formed in opposite ends of the device side terminals 28 and are arranged substantially coaxially with the power supply side nuts 26A and the device side nuts 27A in the power supply side mounts 26 and the device side mounts 27.

The power supply side connector 40 includes a power supply side housing 41 capable of internally accommodating power supply side terminals 42 fixed to respective wires 13 that are bundled into the wiring harness 14. The power supply side housing 41 is made e.g. of synthetic resin and three cavities 44 are formed substantially side by side for accommodating the power supply side terminals 42. A locking lance 45 is provided in each cavity 44 for engaging and retaining the power supply side terminal 42.

A front end of the power supply side housing 41 is connectable with the connecting portion 22 of the device side housing 21, and a seal ring 46 is mounted on the outer periphery thereof to be held in close contact with the connecting portion 22.

Each power supply side terminal 42 is long in forward and backward directions and has a rear end crimped, bent or folded into connection with the end of the wire 13. A front end of each power supply side terminal 42 projects forward from the power supply side housing 41. A bolt insertion hole 42A is formed in the front end of each power supply side terminal 42 and is to be arranged above the bolt insertion hole 28A of the device side terminal 28. A plug 15 of resilient material, such as rubber, is fit on the wire 13 to provide sealing between the wire 13 and the cavity 44.

The first shield shell 50 is aluminum die-cast and includes a case fixing portion 51 and a wall portion 52. The case fixing portion 51 is to be fixed substantially along the outer surface of the case 11 and the wall portion 52 extends substantially perpendicularly up from the case fixing portion 51.

The case fixing portion 51 is shaped to cover substantially the entirety of the upper and outer peripheral surfaces of the flange 23 of the device side housing 21. An accommodation recess 53 is formed in the lower surface of the case fixing portion 51 for receiving the flange 23. The accommodation recess 53 is shaped to conform to the outer shape of the flange 23 and has a depth set so that the lower surface of the seal 34 projects slightly down from the lower surface of the first shield shell 50 when the flange 23 is accommodated.

A rib 54 extends continuously along the periphery of the accommodation recess 53 and aligns with a position on the flange 23 opposite the seal 34 when the flange 23 is accommodated in the accommodation recess 53.

Fixing holes 55 are formed at corners of the case fixing portion 51. The first shield shell 50 is fixed and connected electrically to the case 11 by aligning the fixing holes 55 with screw holes of the case 11 and fastening screws through the holes. The flange 23 of the device side connector housing 21 is held between the outer surface of the case 11 and the first shield shell 50 by fixing the first shield shell 50 to the case 11. Thus, the seal 34 mounted on the lower surface of the flange 23 is held in close contact with the outer surface of the case 11 to provide sealing between the peripheral edge of the mount hole 18 of the case 11 and the flange 23.

The wall portion 52 includes a rear wall 52A that projects up near the connector connecting portion 22 and two side walls 52B, 52C project up at the opposite lateral sides of the connector connecting portion 22.

The rear wall 52A is a wide rectangle slightly larger than the rear surface of the connecting portion 22 and hence entirely covers the rear surface of the connecting portion 22. The rear wall 52A has a height to project slightly up from the connecting portion 22.

The side walls 52B, 52C face a rear part of the connecting portion 22 where the operation hole 29 is formed. A column 56 projects up from the case fixing portion 51 at a position adjacent the front end of the first side wall 52B. The upper end of the column 56 is located slightly above the first side wall 52B (see FIG. 3).

A reinforcing wall 57 projects up from the case fixing portion 51 and extends from the rear wall 52A to the rear edge of the case fixing portion 51.

The second shield shell 60 is aluminum die-cast and has a main body 61 and two legs 62. The main body 61 covers the power supply side connector 40 and the device side connector 20. The legs 62 are arranged on the case fixing portion 51.

The second shield shell 60 is mounted on the power supply side connector 40 until assembly into the connector device 10 and is slid toward the device side connector 20 upon being assembled into the connector device 10.

Figure 8:
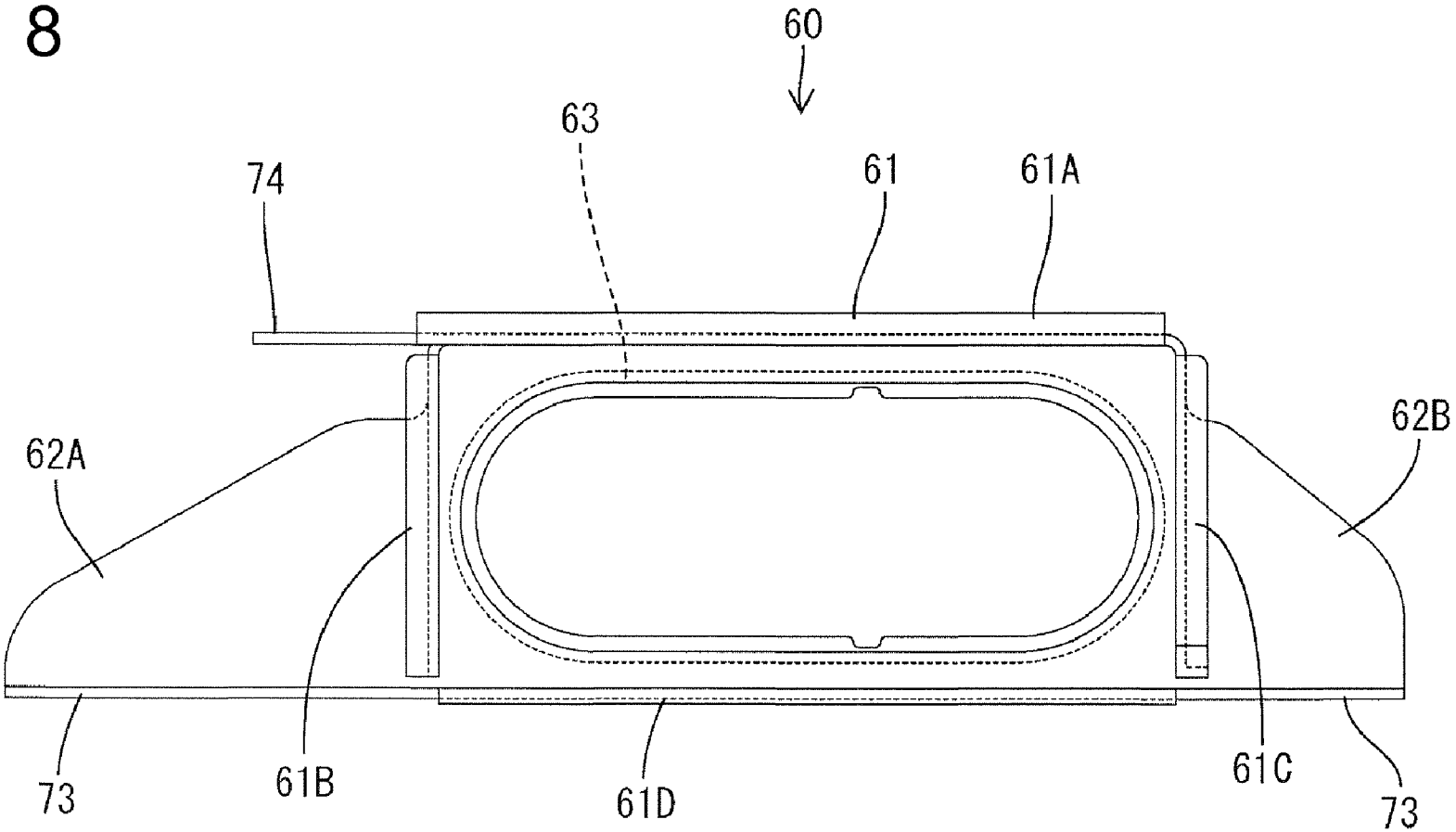
FIG. 8 is a front view of the second shield shell.

The main body 61 of the second shield shell 60 is a rectangular tube with a ceiling wall 61A, two hanging walls 61B, 61C and a bottom wall 61D. The ceiling wall 61A covers the device side housing 21 and the power supply side housing 41 from above (side opposite the case), the hanging walls 61B, 61C cover the side surfaces and the bottom wall 61D covers the lower surface of the power supply side housing 41. When viewed from front, the main body 61 of the second shield shell 60 has a wide rectangular shape (see FIG. 8).

A shielding member 16 (e.g. braided wire or insulation foil) surrounds the wires 13 so that the shielding member 16 and the wires 13 form the wiring harness 14. A crimp ring 17 fixes and electrically connects an end of the shielding member 16 to a fixing portion 63 defined at the rear end of the main body 61.

The ceiling wall 61A is substantially rectangular in a plan view and covers from a front portion of the power supply side connector 40 to the connecting portion 22 of the device side connector 20. The leading end of the ceiling wall 61A reaches a position above the rear wall 52A of the first shield shell 50 when the second shield shell 60 is assembled.

Figure 7:
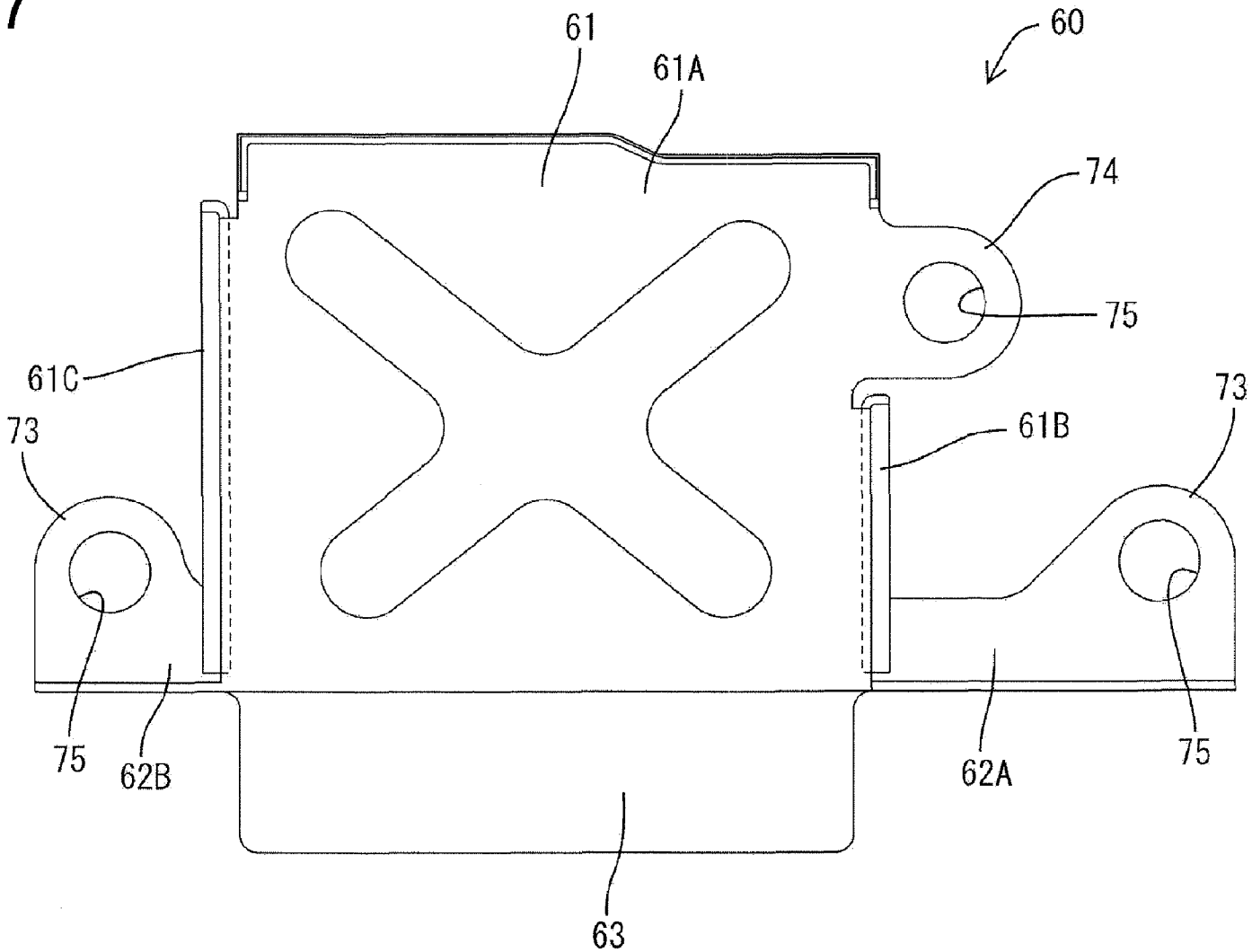
FIG. 7 is a top view of a second shield shell.
Figure 9:
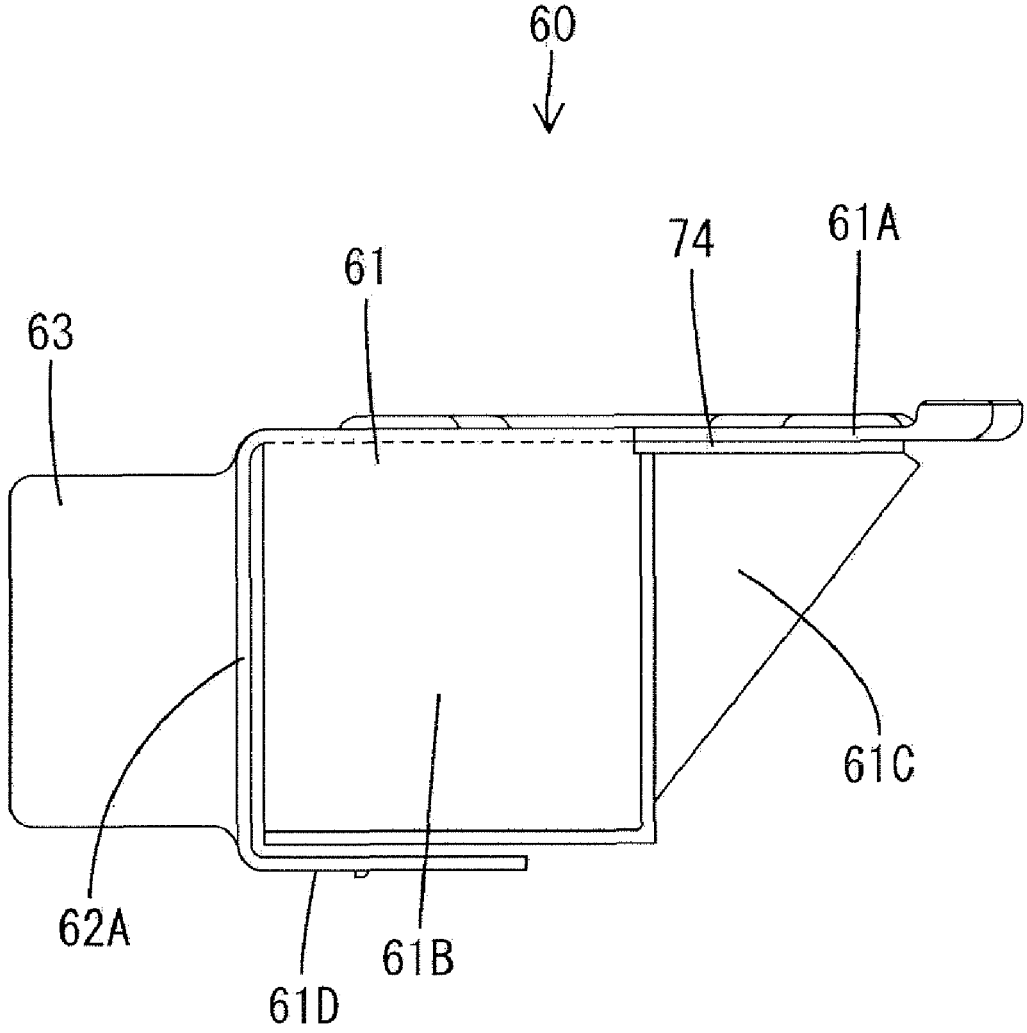
FIG. 9 is a side view of the second shield shell.

The first hanging wall 61B extends from a rear portion of the ceiling wall 61A, as shown in FIG. 7, and is displaced from the first side wall 52B of the first shield shell 50 in forward and backward directions. The first hanging wall 61B is substantially rectangular when viewed from the side and has a substantially constant hanging distance from the ceiling wall 61A in forward and backward directions (see FIG. 9).

The second hanging wall 61C extends forward and backward along substantially the entire extent of the ceiling wall 61A, as shown in FIG. 7. A front portion of the second hanging wall 61C has a substantially triangular shape so that a hanging distance from the ceiling wall 61A decreases gradually toward the front when viewed from the side.

The legs 62A, 62B project sideways from the respective first and second side walls 61B and 61C of the main body 61 so that plate surfaces of the legs 62A, 62B are substantially perpendicular to the first and second side walls 61B and 61C at rear end positions of the main body 61. Bottom edges of the legs 62A and 62B are bent to extend forward. A projecting distance of the first leg 62A from the main body 61 is about twice or more that of the second leg 62B from the main body 61. Parts of the both legs 62A, 62B bent at the bottom ends are placed on the upper surface of the case fixing portion 51 at positions overlapping the screw holes of the case 11 and the fixing holes 55 of the first shield shell 50 to define second low connecting portions 73.

The flange 23 and the connecting portion 22 of the device side connector 20 and the power supply side connector 40 are covered by the first and second shield shells 50, 60 when the device side connector 20 and the power supply side connector 40 are connected and the shield shells 50, 60 are connected.

The first and second shield shells 50, 60 are connected at three positions. More particularly, two low connecting portions are arranged near the outer surface of the case 11 and a high connecting portion is above the low connecting portions.

Two first low connecting portions 71 are provided on the case fixing portion 51 of the first shield 50 and the first high connecting portion 72 is provided at the upper end of the wall portion 52.

The first low connecting portions 71 are located at opposite front corners of the case fixing portion 51 in positions before the wall portion 52 and at substantially the same positions in forward and backward directions. The first low connecting portion 71 at the side of the first side wall 52B is more distant laterally from the wall portion 52 than the first low connecting portion 71 at the side of the second side wall 52C.

The first high connecting portion 72 is at the upper end of the column 56 of the first side wall 52B at an intermediate position of the first shield shell 50 in forward and backward directions and behind the first low connecting portions 71. Further, the first high connecting portion 72 is displaced vertically above the first low connecting portions 71.

The second shield shell 60 has the second low connecting portions 73 at the projecting ends of the respective legs 62A, 62B and the second high connecting portion 74 that projects sideways from the ceiling wall 61A. The second low connecting portions 73 are at the rear end of the ceiling wall 61A and at the bottom ends of the respective legs 62A, 62B so as to be arranged substantially on the case fixing portion 51. The second low connecting portion 73 at the first leg 62A is more distant from the main body 61 than the second low connecting portion 73 at the second leg 62B. The two second low connecting portions 73 are at substantially the same vertical position.

The second high connecting portion 74 is at a lateral edge of the first hanging wall 61B and projects substantially orthogonal to the connecting direction CD of the device side connector 20 and the power supply side connector 40. The second high connecting portion 74 is at the front end of the ceiling wall 61A and overlaps with the first high connecting portion 72.

In this way, the connecting portions of the first and second shield shells 50, 60 are arranged at positions displaced in forward and backward directions (connecting direction CD of the power supply side connector 40 and the device side connector 20) and displaced in the laterally in directions substantially orthogonal to the connecting direction CD.

The first low connecting portions 71 and first high connecting portion 72 of the first shield shell 50 and the second low connecting portions 73 and second high connecting portion 74 of the second shield shell 60 are formed with bolt holes 75 that enable bolt tightening. The bolt holes 75 of the first low connecting portions 71 double as the fixing holes 55 of the case fixing portion 51.

The bolt holes 75 of the first low connecting portions 71 and those of the second low connecting portions 73 and the bolt hole 75 of the first high connecting portion 72 and that of the second high connecting portion 74 are aligned coaxially in the vertical direction.

The device side connector 20 and the first shield shell 50 initially are mounted on the case 11. The device side projecting portion 24 of the device side connector housing 21 then is inserted into the case 11 through the mount hole 18 and the flange 23 is placed along the outer surface of the case 11. Further, the first shield shell 50 is placed on the flange 23.

Subsequently, the power supply side connector 40 is connected with the device side connector 20 along the connecting direction CD with the second shield shell 60 displaced backward with respect to the power supply side connector housing 41. Bolts V then are inserted through the bolt insertion holes 28A of the device side terminals 28 and the bolt insertion holes 42A of the power supply side terminals 42 through the operation holes 29 and tightened into the respective power supply side nuts 26A to be fixed, and the cap 31 is mounted on the operation hole 29. Unillustrated screws are inserted through the fixing holes 55 of the first shield shell 50 except those formed in the first low connecting portions 71 and tightened into the screw holes of the case 11.

The second shield shell 60 then is slid forward so that the main body 61 covers the connector connecting portion 22 of the device side connector 20 and the second low connecting portions 73 and the second high connecting portion 74 are arranged right above the first low connecting portions 71 and the first high connecting portion 72. Bolts (not shown) then are inserted through the bolt holes 75 of the vertically aligned second low connecting portions 73 and first low connecting portions 71 and tightened into the screw holes of the case 11.

Likewise, bolts (not shown) are inserted through the bolt holes 75 of the substantially vertically aligned second high connecting portion 74 and first high connecting portion 72 and tightened into the screw holes of the case 11 to be fixed.

In this way, the first shield shell 50, the second shield shell 60 and the case 11 are connected electrically, thereby completing assembly of the connector device 10.

The connecting portions for connecting the first and second shield shells 50, 60 are provided at the three or more positions and these connecting portions are arranged at the positions displaced in forward and backward directions and the lateral direction. Thus, the number of connected positions is increased as compared with the prior art case where the first and second shield shells are connected at two positions. Further, since the three connecting portions are provided at the positions displaced in forward and backward directions and in the lateral direction, the connected positions of the first and second shield shells 50, 60 are well-balanced and a shielding performance can be improved.

The first low connecting portions 71 and first high connecting portion 72 of the first shield shell 50 and the second low connecting portions 73 and second high connecting portion 74 of the second shield shell 60 are formed with the bolt holes 75 enabling bolt tightening. Thus, the first and second shield shells 50, 60 are fixed firmly by bolt tightening so that a contact state of the first and second shield shells 50, 60 is held reliably.

The invention is not limited to the above described and illustrated embodiment. For example, the following embodiments are also included in the technical scope of the present invention.

Although the connecting portions of the first and second shield shells 50, 60 are provided at the three positions in the above embodiment, they may be provided, for example, at four or more positions without being limited to this.

The first and second high connecting portions 72 and 74 are provided lateral to the connector connecting portion 22 in the above embodiment. However, they may, for example, be behind the connector connecting portion.

The connecting portions of the first and second shield shells 50, 60 include the low connecting portions near the outer surface of the case 11 and the high connecting portions above the low connecting portions in the above embodiment. However, the connecting portions of the shield shells may include only the low connecting portions or only the high connecting portions.

What is claimed is:

1. A connector device in which a connector to be mounted on a conductive case at least partly accommodating a device inside is covered by at least a first shield shell and a second shield shell, wherein connecting portions for connecting the first and second shield shells are provided at least at three positions, the connecting portions being arranged at positions displaced in a connecting direction of the connector and a mating connector and a direction orthogonal to the connecting direction, wherein the connecting portions of the first and second shield shells are formed with bolt holes enabling bolt tightening.

2. The connector device of claim 1, wherein the connecting portions include at least one low connecting portion proximate to an outer surface of the case and at least one high connecting portion more distant from the outer surface of the case than the low connecting portion.

3. The connector device claim 1, wherein the connector has a connecting portion connectable with the mating connector and projecting from the case.

4. The connector device of claim 3, wherein the first shield shell includes at least one case fixing portion to be arranged substantially along the outer surface of the case and at least one wall portion standing up in a projecting direction of the connecting portion from the case fixing portion.

5. The connector device of claim 4, wherein the second shield shell includes at least one leg arranged substantially on the case fixing portion and a main body placed substantially on the connecting portion from a side substantially opposite to the case.

6. The connector device of claim 5, wherein the connecting portions of the first shield shell include at least one first low connecting portion provided on the case fixing portion and at least one first high connecting portion provided at an upper end of the wall portion.

7. The connector device of claim 6, wherein the connecting portions of the second shield shell include at least one second low connecting portion provided on the leg and arranged to overlap with the first low connecting portion and at least one second high connecting portion projecting sideways from the main body and arranged to overlap with the first high connecting portion.

8. A connector assembly comprising the connector device of claim 1 and a mating connector connectable with a connector of the connector device.

9. The connector assembly of claim 8, wherein the mating connector is connected with the connector along the connecting direction by bolts while the second shield shell is displaced.

10. The connector assembly of claim 1, wherein bolts are inserted into the bolt holes in a direction orthogonal to the connecting direction.

11. A connector device in which a connector to be mounted on a conductive case said connector device comprising:

a connector having a device side projection projecting into the case and a connecting portion connectable with a mating connector along a connecting direction and projecting from the case, a first shield shell and a second shield shell covering the connector, connecting portions for connecting the first and second shield shells are provided at least at three positions, the connecting portions being arranged at positions displaced in the connecting direction of the connector and a mating connector and a direction orthogonal to the connecting direction, the first shield shell includes at least one case fixing portion to be arranged substantially along the outer surface of the case and at least one wall portion standing up in a projecting direction of the connecting portion from the case fixing portion, and the second shield shell includes at least one leg arranged substantially on the case fixing portion and a main body placed substantially on the connecting portion from a side substantially opposite to the case.

12. The connector device of claim 11, wherein the connecting portions of the first shield shell include at least one first low connecting portion provided on the case fixing portion and at least one first high connecting portion provided at an upper end of the wall portion.

13. The connector device of claim 12, wherein the connecting portions of the second shield shell include at least one second low connecting portion provided on the leg and arranged to overlap with the first low connecting portion and at least one second high connecting portion projecting sideways from the main body and arranged to overlap with the first high connecting portion.

14. The connector device of claim 11, wherein the connection portions of the first and second shells are formed with bolt holes enabling bolt tightening.

15. The connector assembly of claim 14, wherein bolts are inserted into the bolt holes in a direction orthogonal to the connecting direction.

16. A connector assembly comprising the connector device of claim 11 and a mating connector connectable with a connector of the connector device.

17. The connector assembly of claim 16, wherein the mating connector is connected with the connector along the connecting direction by bolts while the second shield shell is displaced.

* * * * *